US006817810B2

(12) United States Patent
Jones

(10) Patent No.: US 6,817,810 B2
(45) **Date of Patent: *Nov. 16, 2004**

(54) PIERING DEVICE WITH ADJUSTABLE HELICAL PLATE

(76) Inventor: Robert L. Jones, 29505 Golden Gate Canyon Rd., Golden, CO (US) 80403

( * ) Notice: Subject to any disclaimer, the term of this patent is extended or adjusted under 35 U.S.C. 154(b) by 0 days.

This patent is subject to a terminal disclaimer.

(21) Appl. No.: 10/435,288

(22) Filed: May 9, 2003

(65) Prior Publication Data

US 2004/0105727 A1 Jun. 3, 2004

Related U.S. Application Data

(63) Continuation-in-part of application No. 10/308,505, filed on Dec. 3, 2002, now Pat. No. 6,682,267.

(51) Int. Cl.[7] ..... E02D 5/00; E02D 7/74

(52) U.S. Cl. ..... 405/252.1; 405/230; 405/244; 405/253; 405/259.1; 52/157; 411/418; 411/553

(58) Field of Search ..... 405/252.1, 253, 405/259.1, 244, 251, 254, 255, 230; 248/156, 545; 52/155, 157, 161; 411/553, 551, 550, 549, 418, 417

(56) References Cited

U.S. PATENT DOCUMENTS

| | | | | |
|---|---|---|---|---|
| 414,700 A | | 11/1889 | Gray | |
| 1,406,315 A | * | 2/1922 | Whittaker | 411/418 |
| 2,234,907 A | | 3/1941 | Williams | |
| 2,467,826 A | | 4/1949 | Henderson et al. | |
| 3,016,117 A | | 1/1962 | Petersen | |
| 4,239,419 A | | 12/1980 | Gillen, Jr. | |
| 4,290,245 A | | 9/1981 | Pardue, Jr. et al. | |
| 4,316,350 A | * | 2/1982 | Watson | 52/157 |
| 4,334,392 A | | 6/1982 | Dziedzic | |
| 4,712,957 A | * | 12/1987 | Edwards et al. | 411/418 |
| 4,833,846 A | | 5/1989 | McFeetors et al. | |
| 4,911,580 A | | 3/1990 | Gregory et al. | |
| 4,979,341 A | | 12/1990 | Norman et al. | |
| 5,011,336 A | | 4/1991 | Hamilton et al. | |
| 5,120,163 A | | 6/1992 | Holdeman et al. | |
| 5,139,368 A | | 8/1992 | Hamilton et al. | |
| 5,171,107 A | | 12/1992 | Hamilton et al. | |
| 5,213,448 A | | 5/1993 | Seider et al. | |
| 5,408,788 A | | 4/1995 | Hamilton et al. | |
| 5,570,975 A | | 11/1996 | Reinert, Sr. | |
| 5,800,094 A | | 9/1998 | Jones | |
| 6,352,391 B1 | | 3/2002 | Jones | |
| 6,682,267 B1 | * | 1/2004 | Jones | 405/252.1 |
| 2003/0041535 A1 | * | 3/2003 | Rupiper | 52/157 |

FOREIGN PATENT DOCUMENTS

| | | |
|---|---|---|
| FR | 28.547 | 3/1925 |
| JP | 405287996 A | 11/1993 |
| JP | 406193055 A | 7/1994 |
| WO | WO 82/00672 | 3/1982 |

OTHER PUBLICATIONS

Brochure of DYWIDAG–Systems International, Apr. 1993.

* cited by examiner

*Primary Examiner*—Jong-Suk (James) Lee
(74) *Attorney, Agent, or Firm*—Dorr, Carson, Sloan, Birney & Kramer, P.C.

(57) ABSTRACT

A piering device includes a shaft having interspaced threaded portions and unthreaded portions extending axially along at least a portion of its length. The unthreaded portions of the shaft are radially recessed with respect to the threaded portions. A helical plate with a threaded passageway can engage the threaded portions of the shaft at any desired location along the shaft. A key is then inserted into the passageway between the helical plate and an unthreaded portion of the shaft to hold the helical plate at the desired location on the shaft.

14 Claims, 7 Drawing Sheets

Fig. 3
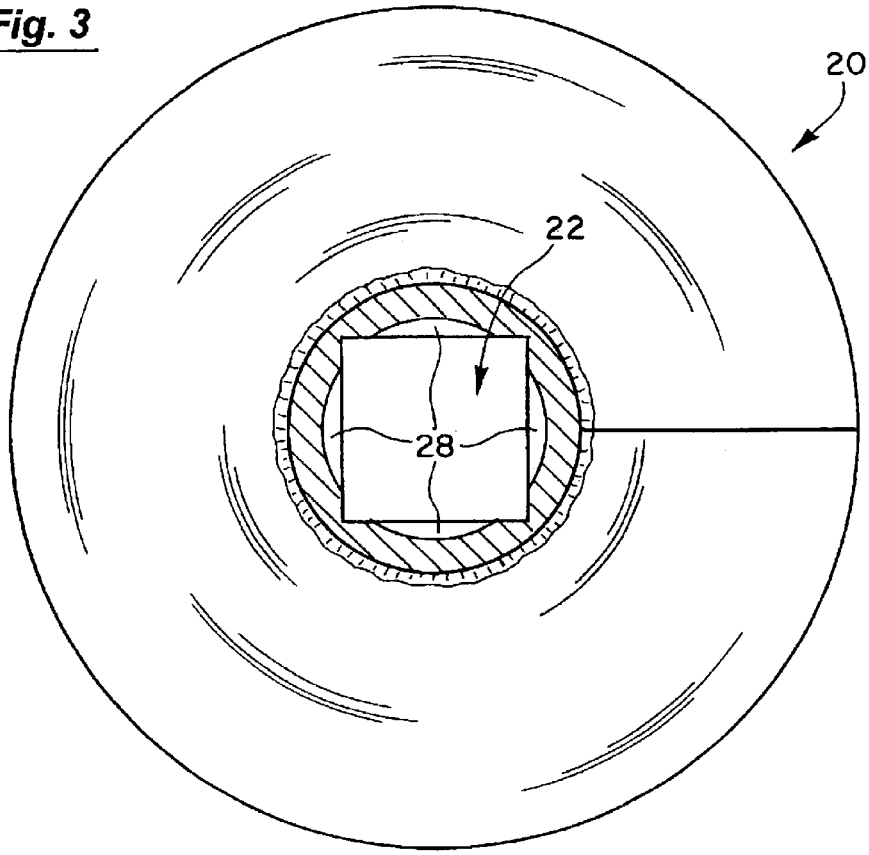
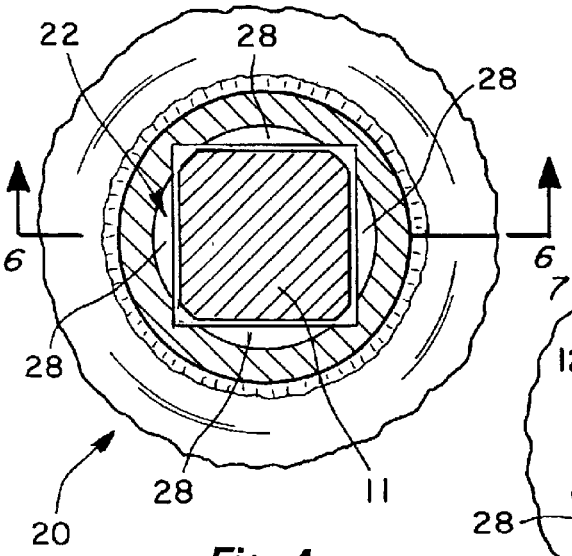
Fig. 4
Fig. 5
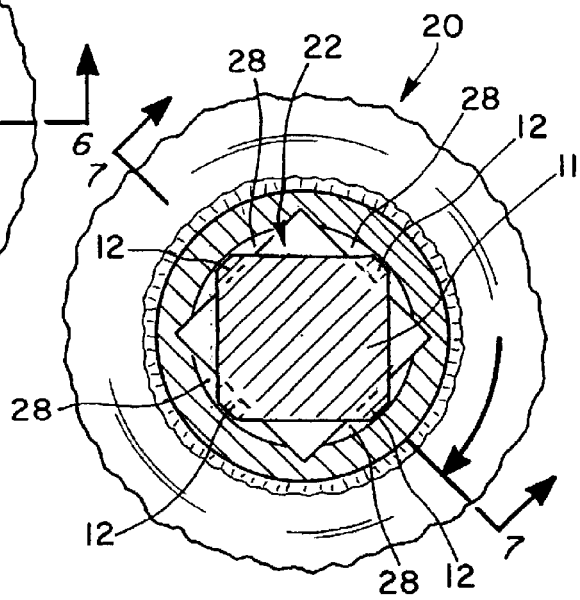

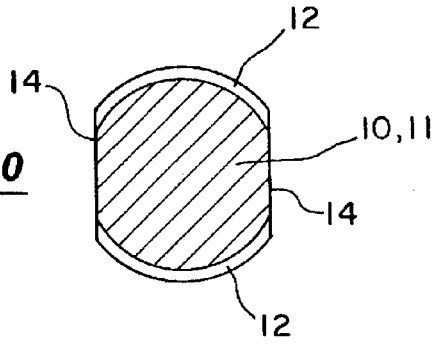
Fig. 10
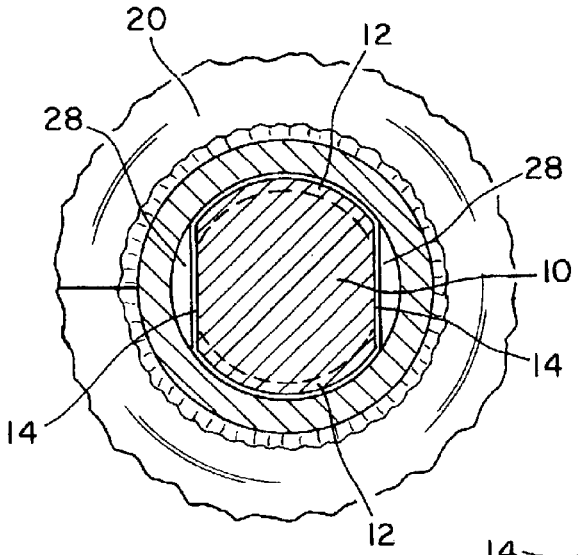
Fig. 11
Fig. 12
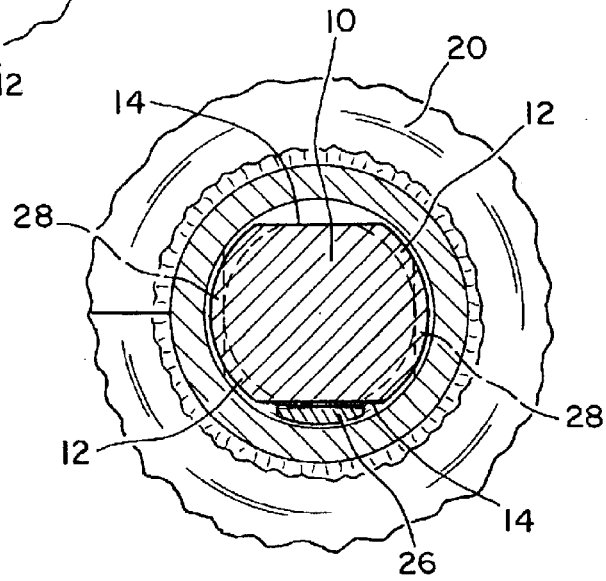

PIERING DEVICE WITH ADJUSTABLE HELICAL PLATE

RELATED APPLICATION

The present application is a continuation-in-part of the Applicant's U.S. patent application Ser. No. 10/308,505, entitled "Piering Device With Adjustable Helical Plate." filed on Dec. 3, 2002, now U.S. Pat. No. 6,682,267.

BACKGROUND OF THE INVENTION

1. Field of the Invention

The present invention relates generally to the field of helical pilings or screw piles. More specifically, the present invention discloses a piering device having an adjustable helical bearing plate.

2. Statement of the Problem

Piering systems have long been used to lift and stabilize foundations of structures, and also in new construction. Some systems employ piles that are driven into the ground adjacent to the foundation, while other piering systems employ helical piles that are screwed into the ground. These piles are also used to anchor structures (e.g., large antennas, or pylons for high voltage lines) that are subject to large wind loads.

Conventional helical piles have an elongated shaft with a helical bearing plate permanently attached to the shaft adjacent to its lower end. The shaft can either be solid or tubular. For example, A. B. Chance Company of Centralia, Mo., markets helical piles having a solid shaft with a substantially square cross-section. The lower end of the shaft is beveled to form a point. The helical bearing plate is welded to the lower end of the shaft adjacent to the bevel. The length of the shaft is fixed, as are the diameter and location of the helical plate. In addition, some installations require several helical plates of different diameters spaced along the shaft. All of this can result in an substantial inventory problem to ensure that the appropriate helical piles are in stock for each job, particularly due to the size and expense of these helical piles.

It is also difficult to accurately predict the length of the piles that will be required for a specific job. Helical pilings are typically screwed into the ground to a point at which a predetermined torque limit is reached. It is difficult to predict what the depth of insertion will be when this torque limit is reached, due primarily to the unpredictable nature of local soil conditions. Therefore, it is often necessary to add an extension to the shaft of the helical pile. For example, A. B. Chance Company markets an extension shaft having a square socket that fits over the upper end of the helical pile shaft. A bolt can be passed through aligned holes in the socket of the extension shaft and the upper end of the helical pile shaft to secure the extension shaft to the helical pile. However, these holes significantly weaken the assembly.

A related problem arises if the shaft of the helical pile is too long. In this case, the upper end of the shaft must be cut off and a new hole must be drilled through the shaft to secure the shaft to the support bracket needed to engage the foundation. This can be difficult and time-consuming in the field.

Thus, a need exists for a helical piling system that is modular in design so that helical plates of various sizes and diameters can be used interchangeably, and various helical plates can be interchangeably combined with a shaft of a desired length. In addition, there is a need to be able to quickly and easily connect shafts to one another in the field to create a shaft assembly of desired length.

3. Prior Art

Other examples of helical pilings are disclosed in the following patents:

| Inventor | Patent No. | Issue Date |
|---|---|---|
| Gray | 414,700 | Nov. 12, 1889 |
| Grimaud | France 561,975 | Mar. 10, 1925 |
| Williams | 2,234,907 | Mar. 11, 1941 |
| Henderson et al. | 2,467,826 | Apr. 19, 1949 |
| Petersen | 3,016,117 | Jan. 9, 1962 |
| Schirm | PCT WO 82/00672 | Mar. 4, 1982 |
| Gillen | 4,239,419 | Dec. 16, 1980 |
| Pardue et al. | 4,290,245 | Sep. 22, 1981 |
| Dziedzic | 4,334,392 | Jun. 15, 1982 |
| McFeetors et al. | 4,833,846 | May 30, 1989 |
| Gregory et al. | 4,911,580 | Mar. 27, 1990 |
| Norman et al. | 4,979,341 | Dec. 25, 1990 |
| Hamilton et al. | 5,011,336 | Apr. 30, 1991 |
| Holdeman et al. | 5,120,163 | Jun. 9, 1992 |
| Hamilton et al. | 5,139,368 | Aug. 18, 1992 |
| Hamilton et al. | 5,171,107 | Dec. 15, 1992 |
| Hamilton et al. | 5,408,788 | Apr. 25, 1995 |
| Seider et al. | 5,213,448 | May. 25, 1993 |
| Reinert | 5,570,975 | Nov. 5, 1996 |
| Jones | 5,800,094 | Sep. 1, 1998 |
| Jones | 6,352,391 | Mar. 5, 2002 |

The applicant's U.S. Pat. No. 6,352,391 (Jones) discloses a piering device having a threaded shaft and an adjustable helical plate held in place by a removable key. However, applicant submits that this patent is not prior art to the present application because the patent was issued less than one year prior to the filing date of the present application and the device disclosed in the patent has not been on sale, in public use, or described in a printed publication more than one year prior to the filing date of the present application.

Gillen discloses a conically-shaped tapered concrete piling with a metallic reinforcement core.

Henderson et al. disclose a lifting slip joint for use in sinking concrete piles into the ground.

Pardue et al. disclose an earth anchor having a shank with a helical blade affixed thereto. A series of shank portions can be connected together axially.

Gray discloses a threaded pile with a threaded helical plate. After the pile has been driven into the ground, the plate is advanced into the ground by rotating a handle attached to a removable sleeve.

Dziedzic discloses a modular screw anchor having an earth-penetrating lead that is separate from the helical plate. In the embodiment shown in FIGS. 2–6 of Dziedzic, the earth-penetrating lead and plate assembly are connected to a rectangular shaft. In the embodiment shown in FIGS. 7–10 of Dziedzic, the shaft is round with threads at its lower end to engage the earth penetrating lead.

Seider et al., Holdeman et al. and Gregory et al. disclose other examples of an apparatus for stabilizing the foundation of a building using a conventional helical piling that has been screwed into the ground.

U.S. Pat. Nos. 5,139,368 and 5,171,107 to Hamilton et al. disclose a system for underpinning a foundation that uses a helical pile with a connecting bracket secured to the foundation.

Schirm discloses a tie rod having a helical plate and a moving foot that can slide along the rod limited by the position of a nut threaded on the rod.

Grimaud is believed to relate to a pile foundation.

Reinert discloses a mobile foundation installation system having a push-it carriage that can push a metal foundation into the ground by hydraulic cylinders pushing against a header frame held and secured in adjustable positions on a mobile tower.

McFeetors et al. disclose a ground anchor system for supporting a structure. A fixed-length helical pile is driven into the ground. The upper end of the piling device includes a screw that allows adjustment of the height of the support head beneath the foundation.

Petersen discloses a screw anchor that receives a square shaft. The anchor is held in place by a pin extending through the anchor and the shaft.

Williams, Norman et al., and Hamilton et al. (U.S. Pat. No. 5,408,788) show examples of screw anchors that can be threaded onto the lower end of a shaft.

The Jones '094 patent discloses a support bracket for attachment to the top of a conventional helical piling.

4. Solution to the Problem

None of the prior art references discussed above show a helical piling with an adjustable helical plate that can be moved along the piling shaft to a desired position, and then be fixed in place by inserting a removable key between the helical plate and shaft. This approach allows one or more helical plates of appropriate size to be placed at desired locations along the length of the shaft to meet the specific needs of each job. The shaft can also be cut to the desired length without waste.

The shaft and helical plate of a helical piling are subject to enormous torsional loads during installation, and very large axial loads (either in compression or tension) after the helical piling has been placed in use. None of the prior art references listed above teach or suggest the present mechanism for removably attaching a helical plate to the shaft to transmit these loads.

SUMMARY OF THE INVENTION

This invention provides a piering device with an adjustable helical plate. The piering device includes a shaft having interspaced threaded portions and unthreaded portions extending axially along at least a portion of its length. The unthreaded portions of the shaft are radially recessed with respect to the threaded portions. The helical plate has a threaded passageway that can engage the threaded portions of the shaft at any desired location along the shaft. A key is then inserted into the passageway between the helical plate and an unthreaded portion of the shaft to hold the helical plate at the desired location on the shaft.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 3 is a horizontal cross-sectional view of the helical plate.

FIG. 4 is a horizontal cross-sectional view of the helical plate in a first rotational position on the shaft allowing the helical plate to slide along the shaft.

FIG. 5 is a horizontal cross-sectional view corresponding to FIG. 4 showing the helical plate after it has been rotated to a second rotational position on the shaft so that the helical plate cannot slide along the shaft

FIG. 10 is a horizontal cross-sectional view of the shaft in FIGS. 8 and 9.

FIG. 11 is a horizontal cross-sectional view of the helical plate in a first rotational position on the shaft in the embodiment shown in FIGS. 8–10.

FIG. 12 is a horizontal cross-sectional view corresponding to FIG. 11 showing the shaft and helical plate in the second rotational position.

DETAILED DESCRIPTION OF THE INVENTION

Figure 1:
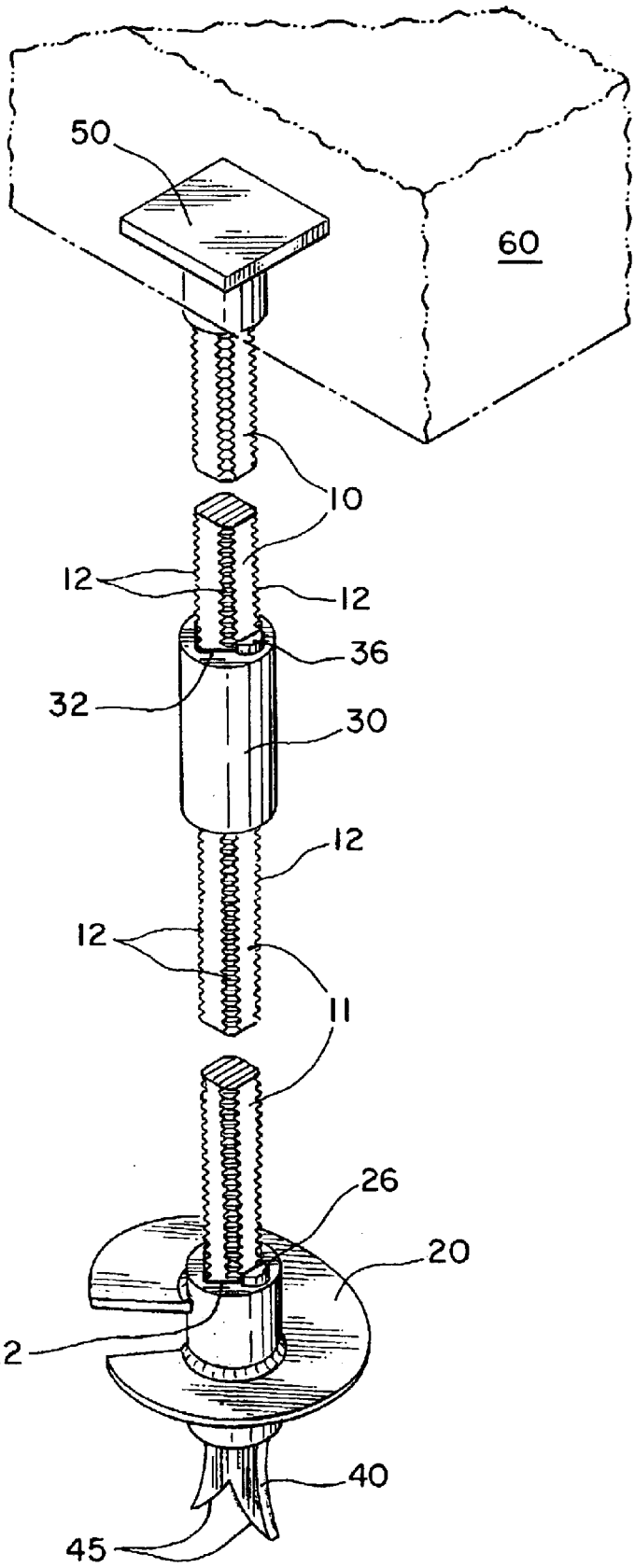
FIG. 1 is a perspective view of the present invention.
Figure 2:
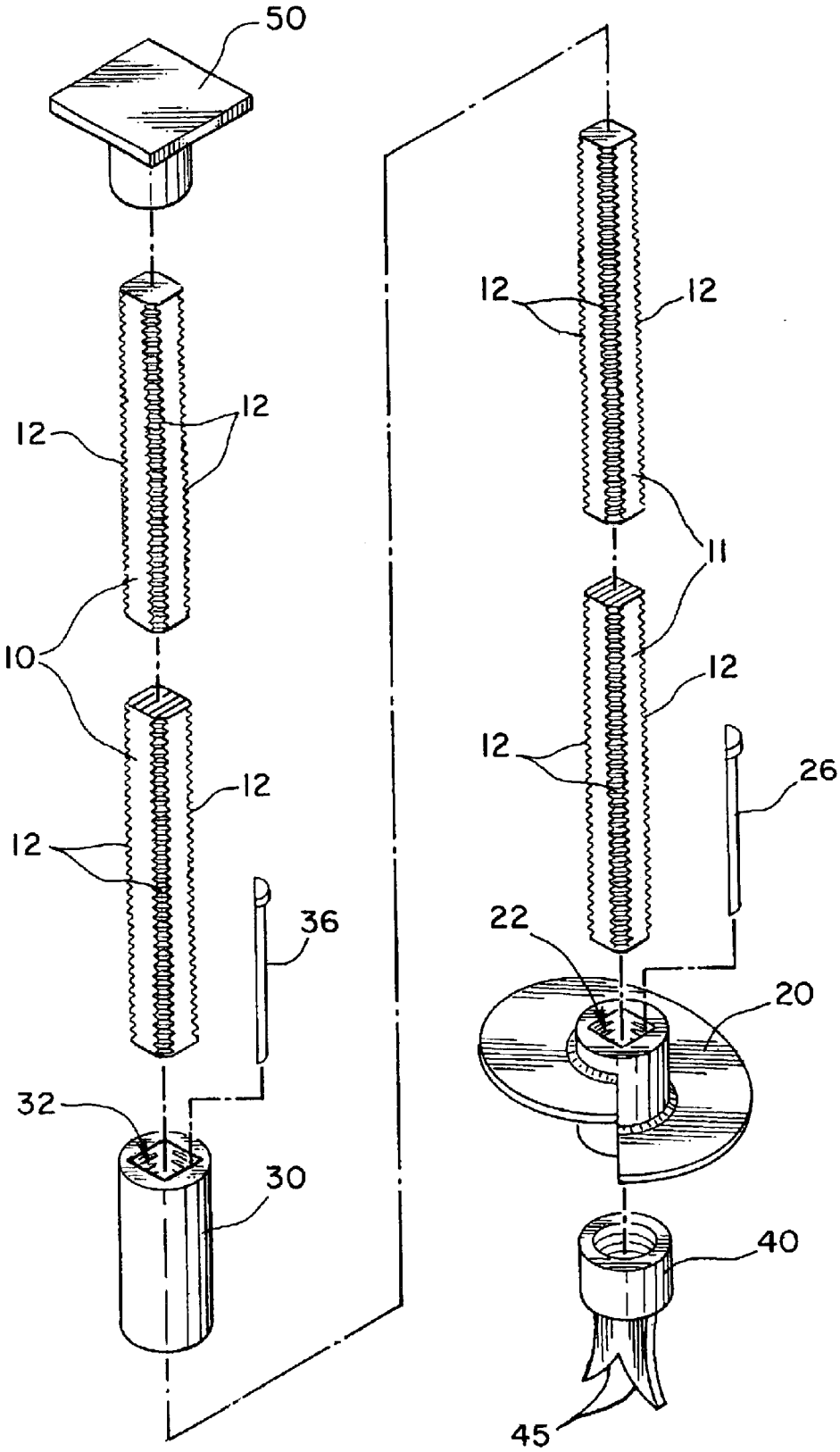
FIG. 2 is an exploded perspective view of the present invention corresponding to FIG. 1.

Turning to FIG. 1, a perspective view is provided of the present device. A corresponding exploded perspective view is shown in FIG. 2. In general terms, the present device consists of a piering shaft 10 and a helical bearing plate 20 that can be removably attached at a desired location along the length of the shaft 10.

The shaft 10 has a generally polygonal cross-section with a plurality of vertices extended along its length. For example, the shaft 10 can have a substantially square cross-section with rounded corners, as illustrated in the drawings. A series of notches 12 are spaced at intervals along the shaft at the vertices. In the embodiment shown in drawings, these sets of notches 12 are axially aligned to form partial threads around the shaft 12. The faces of the shaft 10 between the vertices can be flat or curved, but should be at an effective radius from central axis of the shaft 10 that is less than that of the notches 12, so as not to interfere with rotation of the notches 12 within the passageway 22 of the helical plate 20, as described below. In the preferred embodiment, the notches 12 extend along the entire length of each vertex of the shaft 10. This simplifies fabrication of the shaft 10 and allows the helical plate 20 to be positioned virtually anywhere on the shaft 10. This also makes the present device more modular by enabling two or more shafts 10, 11 to be connected in series using a coupler 30, as shown in FIGS. 1 and 2. Any of a variety of thread configurations can be used on the shaft 10. In the preferred embodiment of the present invention, the notches 12 are rounded to form a partial rope thread. The rounded shape of the thread makes its easier to handle and somewhat less susceptible to damage. Here again, the thread 12 could be limited to selected portions of the shaft, such as the lower end of the shaft 10 to provide a range of positions for the helical plate 20. The upper end of the shaft 10 can also be threaded to engage a coupler 30, if necessary, as shown in FIG. 1. It should be expressly understood that the term "notches" as used in this application should be construed broadly to include all types of indentations, protrusions, grooves, and threads of any type.

Figure 6:
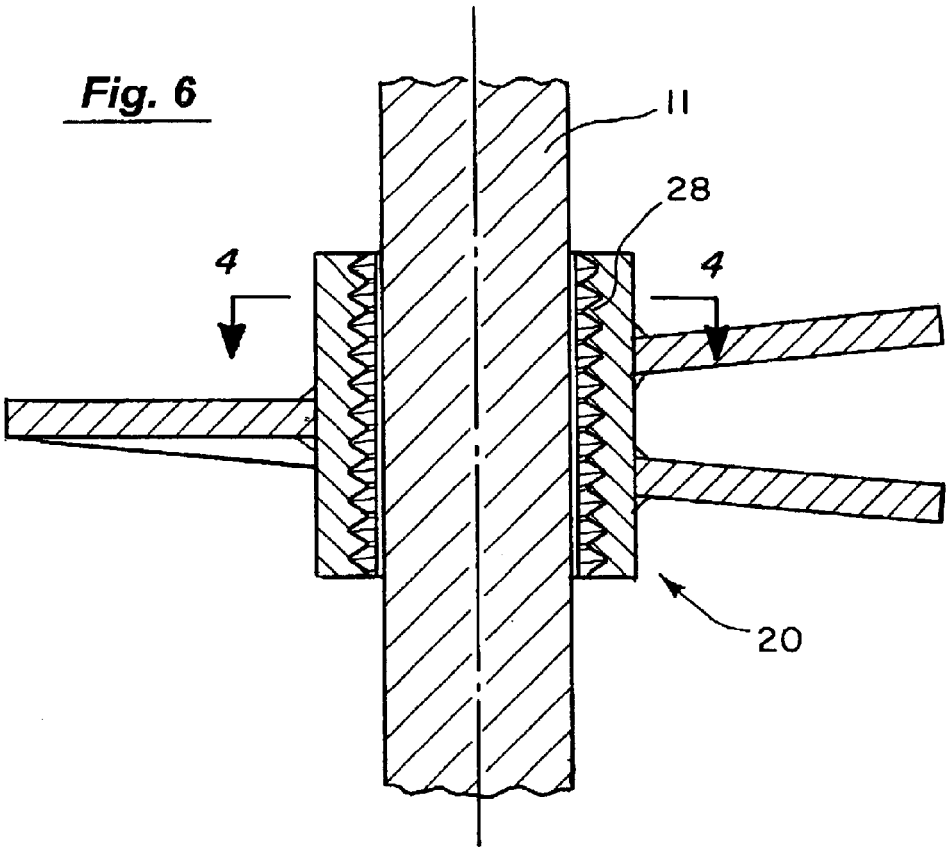
FIG. 6 is a vertical cross-sectional view corresponding to FIG. 4 showing the shaft and helical plate in the first rotational position.
Figure 7:
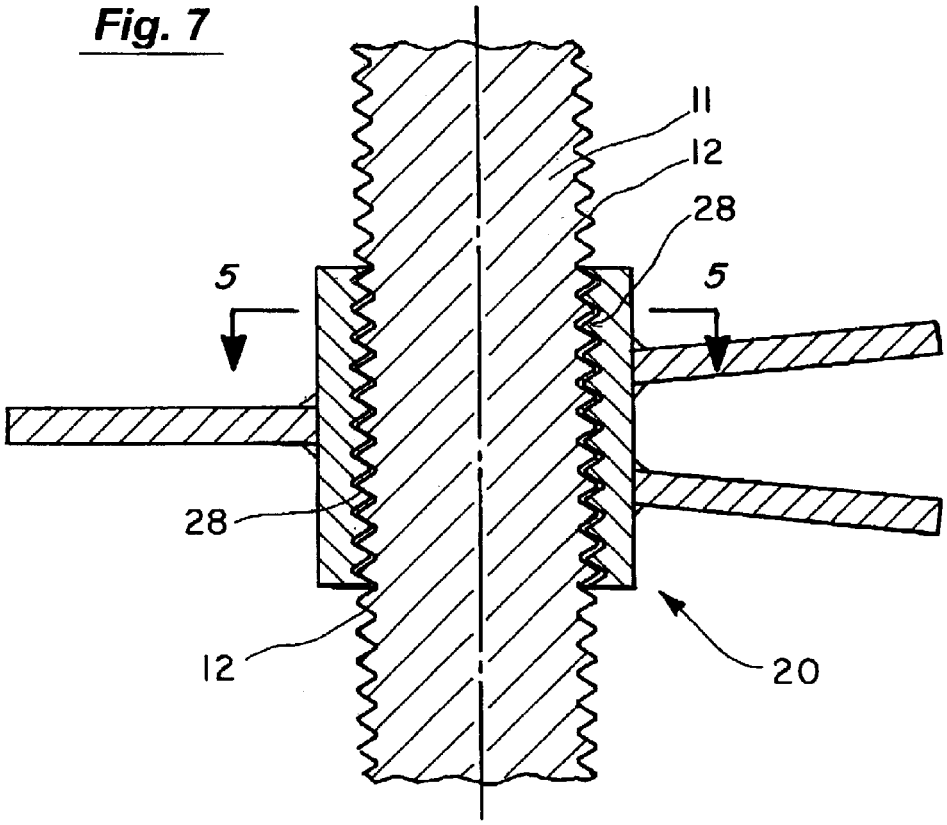
FIG. 7 is a vertical cross-sectional view corresponding to FIG. 5 showing the shaft and helical plate in the second rotational position

The helical bearing plate 20 has a passageway 22 with a cross-section as shown in FIGS. 3–7. This passageway allows the helical plate 20 to slide along the shaft 10 when the helical plate 20 is in a first rotational position on the shaft 10, as illustrated in the orthogonal cross-sectional views shown in FIGS. 4 and 6. The passageway 22 of the helical plate 20 has a series of notches 28 that engage the notches 12 on the shaft 10 when the helical plate 20 is rotated to a second rotational position on the shaft 10, so that the helical plate 20 cannot slide along the shaft 10, as illustrated in FIGS. 5 and 7. For example, if the shaft 10 has a square cross-section as shown in the drawings, the helical plate 20 is rotated by approximately 45 degrees between the first and second rotational positions. In the preferred embodiment of the present invention, the notches 28 in the passageway 22 of the helical plate 20 are axially spaced at regular intervals along the passageway 22 to form partial threads. In the first rotational position, the notches 28 in the passageway 22 of the helical plate 20 are not aligned with the notches 12 on the shaft 10, and therefore do not prevent the helical plate 20 from sliding freely along shaft 10. As shown in FIGS. 4 and 6, the notches 12 on the shaft 10 align with the unthreaded corners in the passageway 22 of the helical plate 20. However, in the second rotational position, these sets of notches 12, 28 engage one another and prevent axial relative movement between the shaft 10 and helical plate 20, as shown in FIGS. 5 and 7. In particular, if the notches form partial threads, these threads do not engage one another in the first rotational position, but do engage one another in the second rotational position.

The helical plate 20 can have any of a wide variety of configurations and sizes. In the embodiment shown in the figures, the helical plate 20 has a generally cylindrical hub with a partially threaded passageway 22 extending completely through the hub. Alternatively, the hub of the helical plate 20 could have a hexagonal outer cross-section so that it can be grasped by a wrench. The helical plate is typically welded onto this hub, although other fastening means could be used.

A key 26 is inserted between the shaft 10 and helical plate 20 to hold the helical plate 20 in the second rotational position and thereby fix the axial position of the helical plate 20 on the shaft 10, as illustrated in FIG. 1. Preferably, two keys are inserted on opposite sides of the shaft 10. The key 26 has a cross-section selected to allow it to be inserted into one of the corners of the passageway 22 of the helical plate 20 in the second rotational position.

A coupler 30 can be used to join two shafts 10, 11, if an especially long shaft is required, as depicted in FIG. 1. The coupler 30 is shown in greater detail in the exploded view provided in FIG. 2. It has a partially threaded passageway 32 extending between two axially-aligned openings that receive the shafts 10 and 11. For example, the embodiment depicted in the figures shows a coupler 30 having a partially threaded passageway with a polygonal cross-section, similar to that of the helical plate 20. The shafts 10, 11 are inserted from opposite ends of the coupler 30 (in the first rotational position) until the ends of the shafts 10, 11 abut. The coupler 30 is rotated by a fraction of a turn until the partial threads in the coupler engage the partial threads on each shaft 10, 11 in the second rotational position. The coupler 30 is then removably secured to the shafts 10, 11 by inserting a key 36 between the shafts 10, 11 and the coupler 30. This configuration is advantageous in that the shafts 10 and 11, rather than the coupler 30, carry most of the large axial loads after installation of the pier. Alternatively, two shorter keys can be inserted from opposite ends of the coupler 30.

In another embodiment, the coupler 30 is simply a threaded cylindrical collar that engages the partial threads 12 on the ends of each shaft 10,11. However, other configurations of the coupler 30 are possible. In addition, the coupler 30 could have a hexagonal outer cross-section so that it can be readily grasped by a wrench.

A variety of optional features can be used with the present device. As shown in FIGS. 1 and 2, a cutting tip 40 can be threaded onto the lower end of the shaft 10. This cutting tip 40 is equipped with a threaded passageway 42 to engage the shaft 10, and a set of cutting blades 45 to drill into the ground beneath the helical plate 20 and thereby reduce resistance as the helical piling is advanced into the ground. In one embodiment, the cutting tip 40 has a hub with a cylindrical threaded passageway 42 to engage the shaft 10. Alternatively, the cutting tip 40 could have a hub with a polygonal, partially-threaded passageway, as similar to that of the helical plate 20. In addition, the hub of the cutting tip 40 could have a hexagonal outer cross-section so that it can be grasped by a wrench.

A flat support bracket 50 can be threaded onto the upper end of the shaft 10 to support a building structure 60 as illustrated in FIG. 1. Other types of support brackets or attachment means can be placed onto the upper end of the shaft to attach a load to the helical pile either in tension or compression. Here again, the support bracket can either be equipped with a threaded cylindrical passageway or a partially-threaded polygonal passageway to engage the upper end of the shaft. For example, the rabbit-ears attachment can be made an integral part of the concrete foundation of a building, as shown in the Applicant's U.S. Pat. No. 6,352,391. Another type of adjustable support bracket that could be readily adapted for use with the present invention is disclosed in the Applicant's U.S. Pat. No. 5,800,094.

Figure 8:
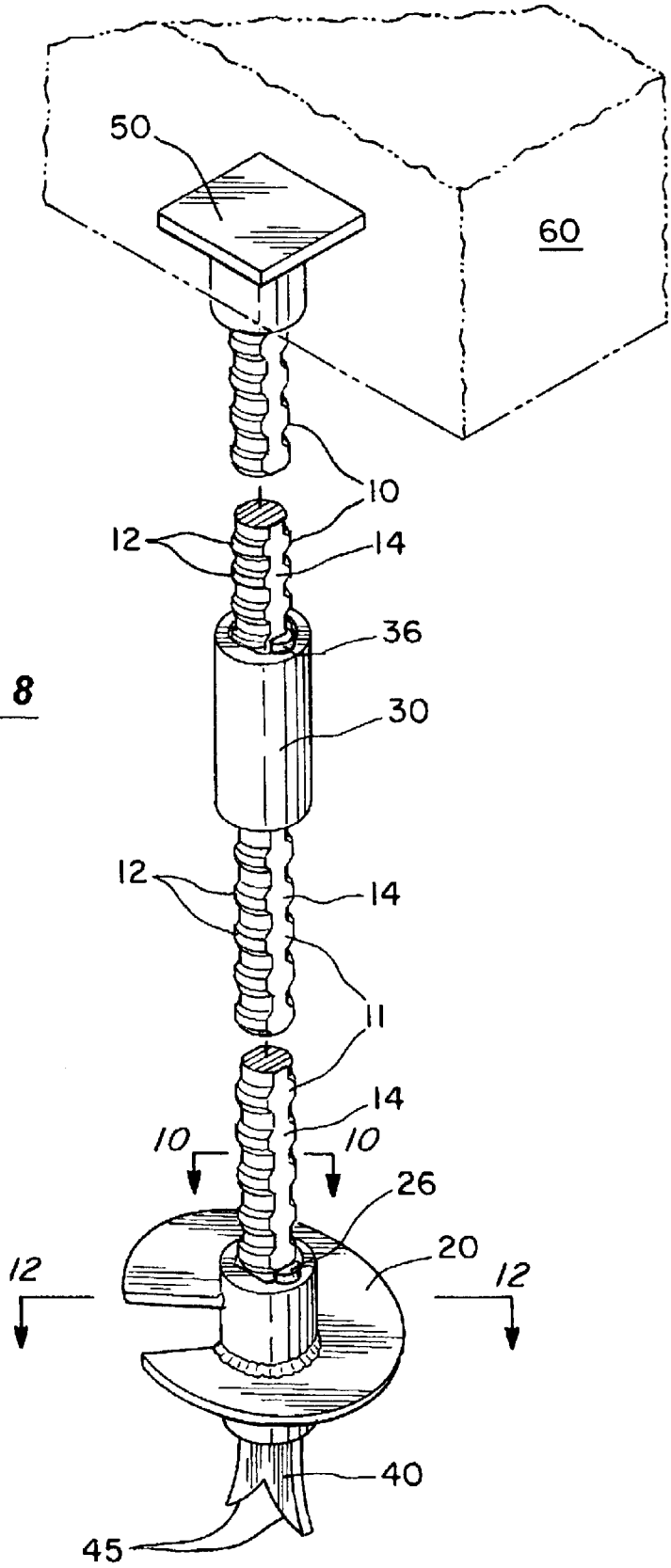
FIG. 8 is a perspective view of an alternative embodiment of the present invention.
Figure 9:
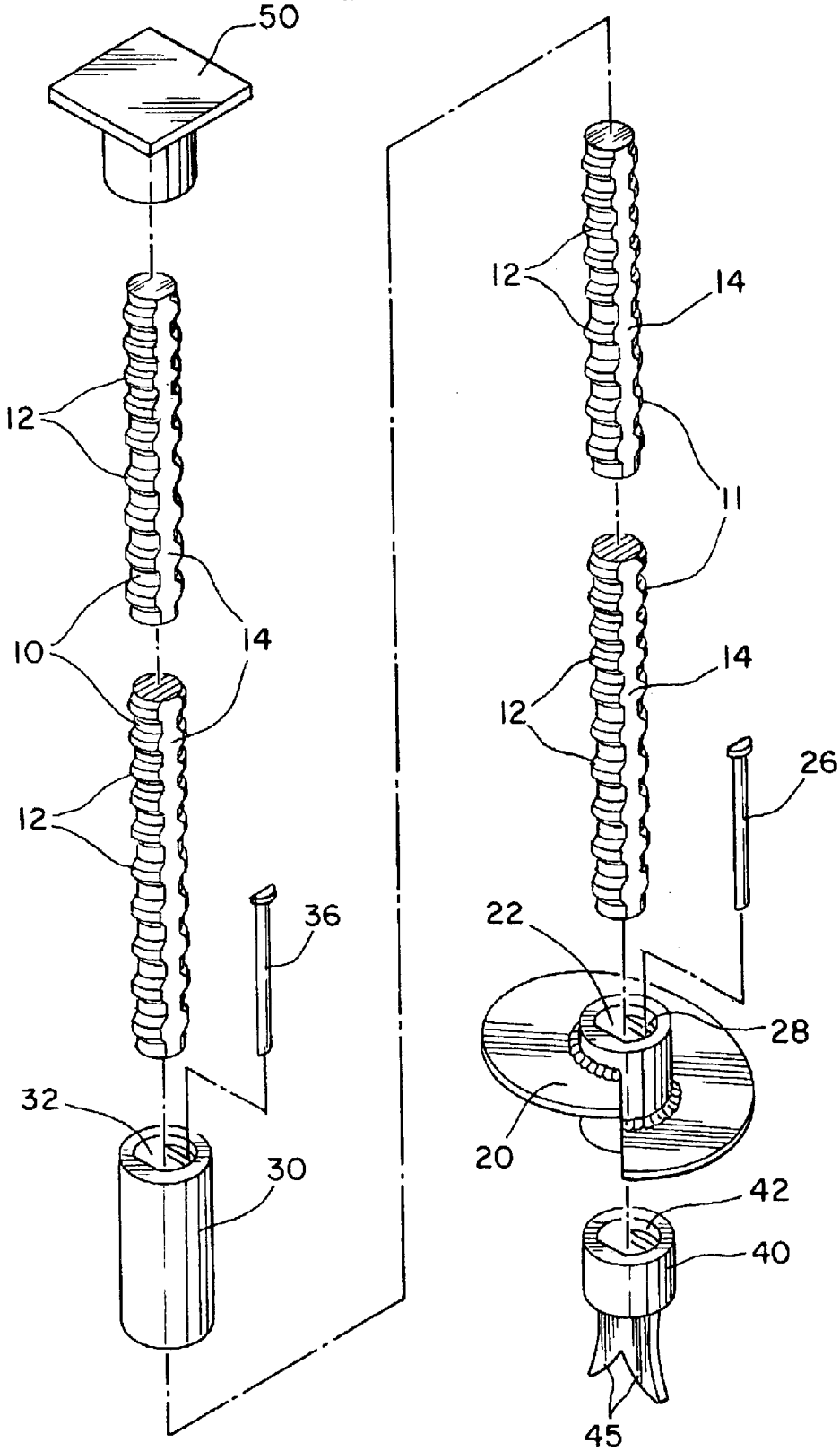
FIG. 9 is an exploded perspective view of the embodiment of the present invention corresponding to FIG. 8.

FIG. 8 is a perspective view of an alternative embodiment of the present invention. FIG. 9 is an corresponding exploded perspective view of this embodiment. In this embodiment, the shaft 10 has a number of threaded portions 12 extending axially along at least a portion of its length. These threaded portions 12 are aligned with one another to form partial threads extending around the shaft 10.

A number of unthreaded portions 14 are interspaced with the threaded portions 12, and also extend axially along at least a portion of the length of the shaft 10. The unthreaded portions 14 are radially recessed with respect to the threaded portions 12, so as not to interfere with rotation of the helical plate 20 about the shaft 10. For example, the unthreaded portions 14 can be substantially flat, as depicted in the horizontal cross-sectional view provided in FIG. 10. However, other shapes or contours are possible.

The helical plate 20 can be moved to any location along the shaft 10, as previously discussed. After the desired location has been reached, a key 26 is then inserted into the passageway between the helical plate 20 and an unthreaded portion 14 of the shaft 10 to prevent further rotation of the helical plate 20 on the shaft 10, and thereby fix the axial position of the helical plate 20 on the shaft 10.

The embodiment shown in FIGS. 8 through 10 has two opposing threaded portions 12 and two opposing unthreaded portions 14. It should be expressly understood that other configurations could be readily substituted. For example, one threaded portion 12 and one unthreaded portion 14 are sufficient. Three or more sets of threaded and unthreaded portions 12, 14 could also be placed around the circumference of the shaft 10. A plurality of unthreaded portions 14 offer the advantage of allowing multiple keys 26 to be inserted between the helical plate 20 and shaft 10. This provides added resistance to torsional loads and reduces the risk that the helical plate would accidentally become loose if a single key is unseated.

It should also be noted that at least two embodiments are possible regarding the threads within the passageway 22 of the helical plate 20. As described above, the passageway 22 can be partially threaded so that the helical plate 20 will slide along the shaft 10 in a first rotational position, but engage the threaded portions 12 of the shaft 10 when the helical plate 20 is rotated to a second rotational position, so that the helical plate 20 cannot slide along the shaft 10. This embodiment is shown in the horizontal cross-sectional views provided in FIGS. 11 and 12. Alternatively, the interior passageway 22 of the helical plate 20 can be completely threaded so that the helical plate 20 can only moved along the shaft 10 by rotating the helical plate 20 on the shaft 10. As before, the helical plate is then held in place by inserting one or more keys 26 into the passageway 22 between the helical plate 20 and the unthreaded portions 14 of the shaft 10.

As previously discussed, multiple shafts 10, 11 can be connected together in series using couplers 30 that are threaded onto the ends of each shaft 10, 11. In addition, a cutting tip 40 can be threaded onto the lower end of the shaft 10. The passageway in the coupler 30 or cutting tip 40 can either be completely threaded or only partially threaded (as previously described regarding the helical plate 20), depending on the type of connection to the shaft 10 that is desired. If the passageway is completely threaded, the coupler 30 or cutting tip 40 must be threaded onto the end of the shaft 10. In contrast, a coupler 30 or cutting tip 40 with a partially threaded passageway can slide onto the end of the shaft 10 in a first rotational position, and then be turned to a second rotational position to engage the threaded portions 12 of the shaft 10. A key 26 is the inserted into the passageway between an unthreaded portion 14 of the shaft 10 and the coupler 30 (or cutting tip 40).

The above disclosure sets forth a number of embodiments of the present invention. Other arrangements or embodiments, not precisely set forth, could be practiced under the teachings of the present invention and as set forth in the following claims.

I claim:

1. A piering device comprising:

a shaft having:

(a) at least one threaded portion extended axially along the shaft and being aligned to form partial threads around the shaft;

(b) at least one unthreaded portion extending axially along the shaft and being radially recessed with respect to the threaded portions;

a helical plate having a passageway with a cross-section to slide along the shaft in a first rotational position on the shaft, and having threaded portions within the passageway to engage the threaded portions of the shaft when the helical plate is rotated to a second rotational position on the shaft so that the helical plate cannot slide along the shaft; and a key insertable into the passageway between the helical plate and an unthreaded portion of the shaft to hold the helical plate in the second rotational position and thereby fix the axial position of the helical plate on the shaft.

2. The piering device of claim 1 wherein the unthreaded portions of the shaft are substantially flat.

3. The piering device of claim 1 wherein the shaft comprises a plurality of threaded portions interspaced with a plurality of unthreaded portions.

4. The piering device of claim 1 further comprising a cutting tip having a cutting blade and a passageway to receive the end of a shaft.

5. The piering device of claim 1 further comprising a coupler having a threaded passageway with two axially-aligned openings to receive and engage the ends of two shafts.

6. A piering device comprising:

a shaft having:

(a) at least one threaded portion extended axially along the shaft and being aligned to form partial threads around the shaft;

(b) at least one unthreaded portion extending axially along the shaft and being radially recessed with respect to the threaded portions;

a helical plate having a threaded passageway to receive and engage the shaft, so that the helical plate can be threaded to a desired location along the shaft; and a key insertable into the passageway between the helical plate and an unthreaded portion of the shaft to prevent rotation of the helical plate on the shaft and thereby hold the helical plate at the desired location on the shaft.

7. The piering device of claim 6 wherein the unthreaded portions of the shaft are substantially flat.

8. The piering device of claim 6 wherein the shaft comprises a plurality of threaded portions interspaced with a plurality of unthreaded portions.

9. The piering device of claim 6 further comprising a coupler having a threaded passageway with two axially-aligned openings to receive and engage the ends of two shafts.

10. The piering device of claim 6 further comprising a cutting tip having a cutting blade and a threaded passageway to receive and engage the end of a shaft.

11. A piering device comprising:

a shaft having:

(a) a plurality of threaded portions extended axially along the shaft and being aligned to form partial threads around the shaft;

(b) a plurality of unthreaded portions extending axially along the shaft and interspaced with the threaded portions of the shaft, said unthreaded portions being radially recessed with respect to the threaded portions;

a helical plate having a threaded passageway to engage the threaded portions of the shaft at any desired location along the shaft; and a key insertable into the passageway between the helical plate and an unthreaded portion of the shaft to hold the helical plate at the desired location on the shaft.

12. The piering device of claim 11 wherein the unthreaded portions of the shaft are substantially flat.

13. The piering device of claim 11 further comprising a coupler having a threaded passageway with two axially-aligned openings to receive and engage the ends of two shafts.

14. The piering device of claim 11 further comprising a cutting tip having a cutting blade and a threaded passageway to receive and engage the end of a shaft.

* * * * *